US008903629B2

(12) United States Patent
Kesch et al.

(10) Patent No.: US 8,903,629 B2
(45) Date of Patent: Dec. 2, 2014

(54) METHOD FOR ADAPTING A FUEL/AIR MIXTURE FOR AN INTERNAL COMBUSTION ENGINE

(75) Inventors: Bernd Kesch, Hemmingen (DE); Holger Jessen, Ludwigsburg (DE); Kai Jakobs, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 386 days.

(21) Appl. No.: 13/429,586

(22) Filed: Mar. 26, 2012

(65) Prior Publication Data

US 2012/0253638 A1 Oct. 4, 2012

(30) Foreign Application Priority Data

Mar. 31, 2011 (DE) ..... 10 2011 006 587

(51) Int. Cl.
*F02D 41/24* (2006.01)
*F02D 41/14* (2006.01)

(52) U.S. Cl.
CPC ..... *F02D 41/1402* (2013.01); *F02D 41/2454* (2013.01); *F02D 2041/141* (2013.01); *F02D 41/2477* (2013.01)
USPC ..... 701/103; 701/106; 123/672

(58) Field of Classification Search
CPC ..... F02D 41/1402; F02D 41/2454; F02D 41/2477; F02D 2041/141
USPC ..... 701/103, 106; 123/672, 704; 73/114.69, 73/114.71, 114.72
See application file for complete search history.

(56) References Cited

U.S. PATENT DOCUMENTS

| | | | | |
|---|---|---|---|---|
| 4,584,982 | A | 4/1986 | Clement et al. | |
| 6,655,346 | B2 * | 12/2003 | Esteghlal et al. | 123/295 |
| 7,209,824 | B2 * | 4/2007 | Henn et al. | 701/103 |
| 7,438,066 | B2 * | 10/2008 | Michalske et al. | 123/674 |
| 7,920,955 | B2 * | 4/2011 | Bauer et al. | 701/103 |
| 8,108,128 | B2 * | 1/2012 | Zurlo et al. | 701/108 |
| 8,600,646 | B2 * | 12/2013 | Haft et al. | 701/103 |
| 2014/0012486 | A1 * | 1/2014 | Fey | 701/103 |

FOREIGN PATENT DOCUMENTS

EP 1382822 1/2004

* cited by examiner

*Primary Examiner* — Hai Huynh
(74) *Attorney, Agent, or Firm* — Michael Best & Friedrich LLP

(57) ABSTRACT

A method for adapting a mixture for a pilot control process for setting a fuel/air mixture for operating an internal combustion engine. The method includes determining a current measuring point from an air and fuel quantity in which a predefined lambda is achieved, determining a current operating range in which the measuring point lies, determining a deviation of the measuring point from the operating point lying in the current operating range, determining a corrected operating point between the operating point and the measuring point, and determining corrected parameters of a parameterized relationship from the corrected operating point and the operating points and parameter values of the preceding adaptation step not lying in the current operating range, and permits adaptation of a mixture without separation of load/rotational speed ranges for adaptation of the offset and of the factor of the linear relationship of air quantity and fuel quantity.

13 Claims, 2 Drawing Sheets

METHOD FOR ADAPTING A FUEL/AIR MIXTURE FOR AN INTERNAL COMBUSTION ENGINE

BACKGROUND OF THE INVENTION

The invention relates to a method for adapting a mixture of a pilot control process for setting a fuel/air mixture for operating an internal combustion engine, wherein the pilot control process sets a fuel quantity as a function of an air quantity by means of an adaptable parameterized relationship.

When controlling the fuel/air ratio, the lambda value and the mixture for operating internal combustion engines it is customary to superimpose a closed-loop control process on a pilot control process. Furthermore, it is known to derive correction variables from the behavior of a closed-loop control variable in order to bring about incorrect adaptation of the pilot control process to changed operating conditions. This process is also referred to as adaptation of a mixture. U.S. Pat. No. 4,584,982 describes adaptation of a mixture with different adaptation variables in different ranges of the load rotational speed spectrum of an internal combustion engine. The different adaptation variables serve to correct different types of error. An error in the determination of the air mass flow rate acts multiplicatively on the metering of fuel. Influence of leakage air acts additively per time unit. An error during the compensation of switch-on delay of the injection valves acts additively per injection. These systematic errors are corrected by the mixture adaptation. The mixture deviations are adapted in the load/rotational speed range in which they have strong effects. Additive mixture deviations are adapted in the lower load/rotational speed range, and multiplicative deviations are adapted in the central load/rotational speed range. Calculated corrections are then used in the entire load/rotational speed range. According to legal specifications, errors which are relevant to exhaust gas are to be detected with on-board means and, if appropriate, an error lamp is to be activated. The adaptation of the mixture is also used for error detection. If correction intervention of the adaptation is strikingly large, this indicates an error.

EP 1382822 A2 discloses a method for adapting a fuel/air mixture in an internal combustion engine, in which various types of mixture deviations are adapted, in which during or after the adaptation of a first type of mixture deviation the influence of the first type of mixture deviation on an adaptation which has taken place beforehand of a second type of mixture deviation is estimated, and in which the adaptation of the second type of mixture deviation is corrected as a function of this estimate.

A disadvantage with the known methods for adapting a mixture is that for robust and rapid adaptation of a mixture said adaptation has to take place in two load/rotational speed ranges which are separate from one another. In particular, an intermediate range is necessary in which no adaptation takes place, in order to avoid oscillation of the adaptation between the adaptation values which correspond to the types of error. It is also disadvantageous that the known methods require regular operation in the lower load/rotational speed range since otherwise additive errors cannot be corrected. However, in motor vehicles with a hybrid drive operation of the internal combustion engine in the lower load/rotational speed range is avoided and is covered with an electric drive.

The object of the invention is therefore to make available a method for the improved and accelerated adaptation of a mixture for an internal combustion engine.

SUMMARY OF THE INVENTION

The object of the invention which relates to the method is achieved in that during an adaptation process in a current adaptation step a current measuring point is determined from an air quantity and a fuel quantity in which a predefined lambda is achieved, in that the current operating range in which the measuring point lies is determined, in that the deviation of the measuring point from the operating point lying in the current operating range is determined, in that a corrected operating point between the operating point and the measuring point is determined, and in that corrected parameters of a parameterized relationship are determined from the corrected operating point and the operating points and parameter values of the preceding adaptation step not lying in the current operating range. The method permits adaptation of a mixture in the entire load/rotational speed range without a distance between partial ranges for the adaptation of the offset and of the factor of the linear relationship of air quantity and fuel quantity, and therefore makes available a more robust method for adaptation of the mixture. The method permits, through the possibility of adaptation in all the operating ranges for start/stop and hybrid drives, idling phases to be dispensed with more frequently, therefore permitting the fuel consumption to be reduced. The adaptation of the mixture is ended when the rate of change in the adaptation values drops below a predefined limit or when the adaptation values change by fewer limiting values than those predefined between the adaptation steps. Instead of being logically combined with the air quantity, the fuel quantity can also be combined with another variable for carrying out the method which represents the load of the internal combustion engine.

In one preferred refinement of the method the adaptable parameterized relationship is formed as a linear relationship which is determined by an offset and a gradient and runs through at least two operating points which are respectively determined by an air quantity and a fuel quantity and which lie in operating ranges of the internal combustion engine which are assigned to the respective operating points, wherein a corrected offset and a corrected gradient of a corrected linear relationship are determined as corrected parameters from the corrected operating point and the operating points not lying in the current operating range as well as the offset and the gradient of a linear relationship which is determined in a preceding adaptation step.

In a further preferred refinement of the method according to the invention, a parameterized nonlinear relationship is determined by determining the parameters during an adaptation process from the current measured values and the parameter values of the preceding adaptation step.

If the corrected operating point is positioned on a line between the operating point in the current operating range and the measuring point, at a distance from the operating point which is determined by a first weighting factor, in this refinement of the method according to the invention it is possible to set an adaptation speed by means of the first weighting factor.

A particularly robust embodiment of a means for adapting a mixture provides that the corrected, preferably linear, relationship is determined by the operating points in such a way that a mean square error of the deviation of the linear relationship, corrected in the current adaptation step, from the observed measured operating points is minimized. It is possible to provide here that the corrected linear relationship which is determined in the current adaptation step is determined from the linear relationship which is determined in the preceding adaptation step and a correction which is provided with a weighting factor and is formed from the difference between the new linear relationship, determined by minimizing the mean square error in the current adaptation step, and the linear relationship from the previous adaptation step. In the current adaptation step, the corrected offset and the corrected gradient are determined from the offset determined in the preceding adaptation step and the gradient determined there, and the offset determined by minimizing the mean square error in the current adaptation step and the gradient.

A particularly robust method for adapting a-mixture is defined by the fact that the corrected, preferably linear, relationship is determined from three operating points, one of which is an operating point which is corrected in the current adaptation step. The number of operating points composed of value pairs of relative air charge and relative fuel mass can also be selected to be larger than three.

The operating points composed of relative air charge and relative fuel quantity are characterized by value pairs x, y. The determination of the operating point for the current operating range is carried out in such a way that a new value pair $x_i$, $y_i$ is determined from a preceding value pair $x_{i-1}$, $y_{i-1}$ and a correction, provided with a weighting factor, formed from the difference of a currently observed value pair x, y and a preceding value pair $x_{i-1}$, $y_{i-1}$. In the low load/rotational speed range, the adaptation of the offset can take place with more precision without degrading the adaptation of the factor, and in a central load/rotational speed range the adaptation of the factor can take place more precisely without degrading the adaptation of the offset.

If there is still no measured value for an operating point present in an operating range, start values for an adaptation of a mixture (initial/ECU reset) can be advantageously determined by setting the offset to be equal to zero for an initial determination of a corrected, preferably linear, relationship and determining the gradient of the linear relationship at an operating point of the internal combustion engine or by determining the offset from the deviation and setting the factor to be equal to 1.

In one development of the method it is possible to provide that a second weighting factor is determined as a function of the distance of the current operating point from a limit of the operating ranges in such a way that the second weighting factor is small when the distance is small and large when the distance is large, and that during the determination of the corrected, preferably linear, relationship the contribution of the correction to the linear relationship is weighted with the second weighting factor.

If the determination of the corrected, preferably linear, relationship is carried out in each case with a weighting factor for the offset and one for the factor, the adaptation can be ended with a minimum expenditure of time with the largest possible degree of accuracy. An adaptation is ended if the current adaptation step undershoots a predefined limiting value for the correction in absolute or relative terms. The weighting factor has the effect that in an adaptation step the current measured value is taken into account to a greater or lesser degree. In the case of a low weighting factor, the adaptation moves slowly toward the end value. In the case of a high weighting factor, the adaptation moves more quickly toward the end value, but in certain circumstances can be subject to a relatively large fluctuation. By defining a suitable weighting factor for the adaptation of the one parameter, for example for the adaptation of the offset, and of a suitable weighting factor—under certain circumstances different therefrom—for the second parameter, for example for the factor, a different adaptation rate for the parameters can be set. In one expanded embodiment different weighting of the contributions of the target function can be performed according to operating ranges.

In one development of the method there is provision that the function for minimizing the mean square error of the operating points provides different weighting factors in different operating ranges.

If the square minimization is carried out by means of a continuous calculation method based on current measured values over the entire operating range of the internal combustion engine, it is possible to dispense with differentiation of operating ranges in which different rules for determining the adaptation have to be used.

BRIEF DESCRIPTION OF THE DRAWINGS

The invention will be explained in more detail below with reference to an exemplary embodiment which is illustrated in the figures. In said exemplary embodiment.

DETAILED DESCRIPTION

Figure 1:
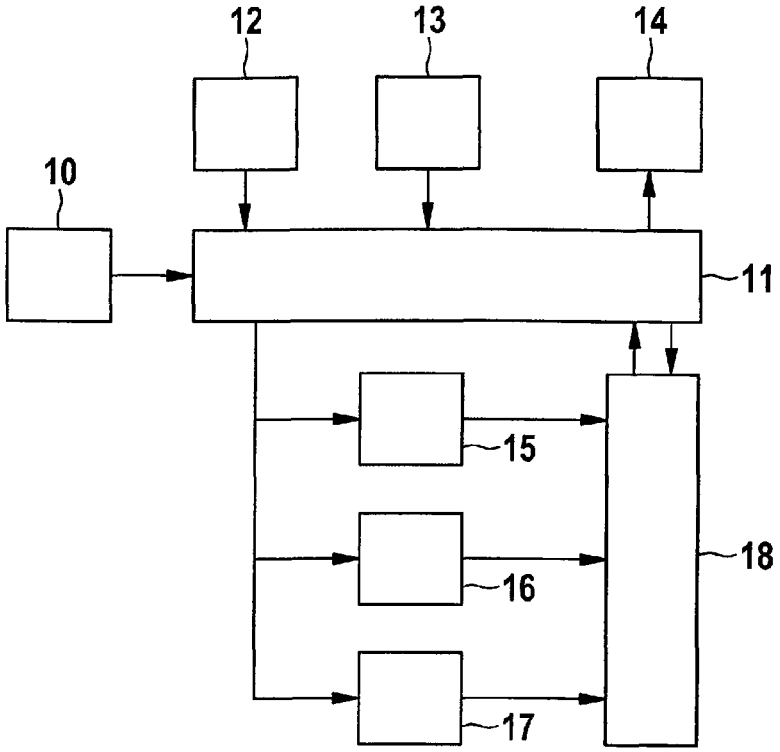
FIG. 1 shows the technical environment in which the invention can be used.

FIG. 1 shows, in an exemplary embodiment, the technical environment in which the invention can be used. An engine controller 11 of an internal combustion engine (not shown) is illustrated. Signals of a rotational-speed-detection means 10, of a load-detection means 12 and of a mixture-detection means 13 are fed to the engine controller 11. A fuel-metering device 14 is actuated by the engine controller 11.

Furthermore, a first adaptation means 15, a second adaptation means 16 and a third adaptation means 17 are assigned to the engine controller 11. The adaptation means 15, 16, 17 are connected to a calculation block 18 which has a bidirectional connection to the engine controller 11. The rotational-speed-detection means 10 provides the engine controller 11 with the current rotational speed of the internal combustion engine as an output signal. The load-detection means 12 informs the engine controller 11 about the current engine load with which the internal combustion engine is being operated. In the present exemplary embodiment, the engine load is described by a relative air charge of the internal combustion engine, which is communicated to the engine controller 11 by the load-detection means 12. The mixture-detection means 13 is embodied as a lambda probe which is arranged in the exhaust duct of the internal combustion engine. The mixture-detection means 13 therefore provides the engine controller 11 with a signal relating to the current fuel/air ratio with which the internal combustion engine is being operated.

The engine controller 11 actuates the fuel-metering device 14 which is embodied as an injection valve and with which the fuel quantity which is supplied to the internal combustion engine is predefined. The necessary fuel quantity is set here, inter alia, as a function of the engine load and the required lambda value by a lambda closed-loop controller which is integrated in the engine controller, wherein the basic setting is carried out by means of an adaptable pilot control process which is contained in the lambda closed-loop controller. For this purpose, the output signal of the pilot control process is added to the output signal of a lambda closed-loop controller. The pilot control process defines the fuel quantity, inter alia, on the basis of the engine load. The relationship between the engine load and the fuel quantity to be predefined is stored in the engine controller 11. The relationship between the engine load and the fuel quantity to be predefined can change owing to system drifting. In order to compensate for this, adaptation cycles, in which the relationship in the pilot control process is re-learnt, are provided within the scope of a mixture adaptation.

During the adaptation of the mixture, systematic errors of the fuel/air mixture are corrected using adaptation values which are formed by the adaptation means 15, 16, 17 and the calculation block 18 arranged downstream. In this context, different types of errors which lead to mixture deviations can occur. Errors in the determination of the air quantity which is supplied to the internal combustion engine act multiplicatively on the metering of fuel, while errors which are caused by influences of leakage air or by a switch-on delay of the injection valves act additively. Multiplicative errors can be perceived particularly in the central load range of the internal combustion engine, while additive errors are predominant at low loads. Correspondingly, the adaptation of the metering of fuel in accordance with known methods relating to multiplicative errors preferably occurs in the central load range, and in accordance with known methods relating to additive errors preferably occurs in the low load range. Since multiplicative errors are also effective in low load ranges and additive errors are also effective in central load ranges, the adaptation is carried out alternately in the two load ranges until a sufficiently stable adaptation of the pilot control process has occurred.

In order to achieve robust adaptation it is advantageous, for the purpose of determining the adaptation values, to differentiate three computationally determined operating points of relative air charge and relative fuel mass with associated operating ranges. The three operating points are adapted in the respectively assigned adaptation means 15, 16, 17. The number of the operating points and therefore adaptation means 15, 16, 17 can also be reduced to two or selected to be larger. In the calculation block 18, the adaptation values are determined in the form of a factor for the multiplicative mixture deviation, and in the form of an offset for the additive mixture deviation, from the adapted operating points.

Figure 2:
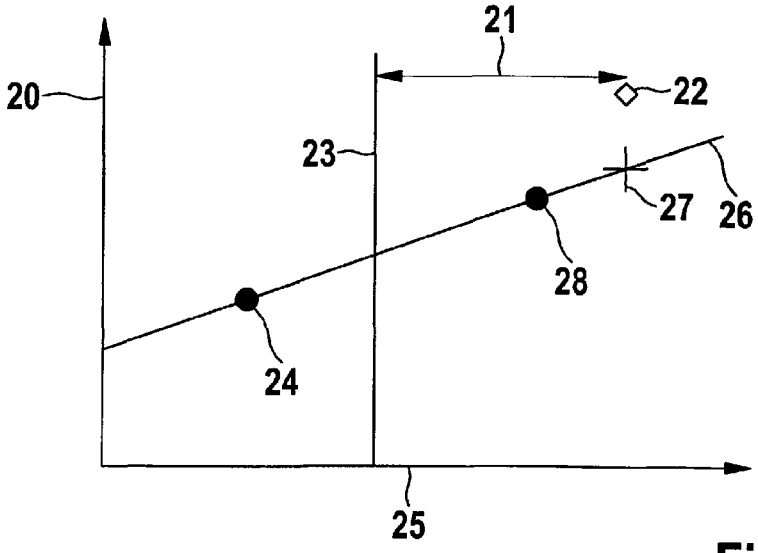
FIG. 2 shows a diagram representing an adaptation process.

FIG. 2 shows an exemplary embodiment for a linear relationship y=a+b*x in a diagram for representing an adaptation process. A relative fuel quantity 20 is plotted with respect to a relative air charge 25 which is a measure of the load at which the internal combustion engine is operated. The relationship between the relative air charge 25 and the relative fuel quantity 20, on which the pilot control process is based, is characterized by a straight line 26 which runs through a first operating point 24 and a second operating point 28. The operating points 24, 28 are each assigned to an operating range which is separated at a threshold 23. A current measuring point 22 is represented by a rhombus at an illustrated distance 21. The position of the current measuring point 22 is projected onto the straight line by a mark 27. The straight line 26 is described by an offset a and a gradient b.

During the regular operation of the internal combustion engine, the metering of the fuel quantity is corrected by the pilot control process as a function of the relative air charge 25 along the straight line 26. In order to compensate for deviations occurring in the relationship between the relative air charge 25 and the necessary relative fuel quantity 20 occurring in the course of time in order to achieve a predefined lambda, the profile of the straight line 26 has to be adapted to the changed system properties within the scope of adaptation processes which are to be carried out regularly. For this purpose, the offset a and gradient b parameters of the straight line 26 are adapted.

In the example shown, at the current measuring point 22, described by the coordinates xv along the axis of the relative air charge 25 and yv along the axis of the relative fuel quantity 20, the relative fuel quantity 20 which is actually necessary, given the predefined relative air charge 25, to achieve a predefined lambda deviates from the expected relative fuel quantity 20, as indicated by the mark 27 on the straight line 26. Correspondingly, the straight line 26 and the offset a and gradient b parameters which describe the straight line 26 have to be adapted. The adaptation of the straight line 26 for a current measuring point 22, which deviates from the second operating point 28, is subsequently represented in the second operating range. The method can appropriately also be carried out for a determined deviation of a current measuring point 22 in the first operating range from the first operating point 24 or for further operating ranges (not illustrated here) with associated operating points 24, 28.

The second operating point 28 was determined in a preceding adaptation process (i−1). For the representation of the calculation of the new adaptation values, the coordinates of the second operating point are correspondingly indexed with x2 (i−1) and y2 (i−1).

During the current adaptation i, in the second operating range the abscissa x2(i) and the ordinate y2(i) are calculated from the actual values of the current measuring point 22 xv, yv and the adaptation values from the preceding adaptation process (i−1) according to:

$$2(i)=x2(i-1)+\text{alpha}*(xv(i)-x2(i-1))$$

$$y2(i)=y2(i-1)+\text{alpha}*(yv(i)-y2(i-1))$$

The coordinates of the first operating point 24 which is determined during the preceding adaptation remain unchanged during the correction in the first operating range:

$$x1(i)=x1(i-1)$$

$$y1(i)=y1(i'1)$$

Alpha is here a factor <1 with which the adaptation rate is defined. xv and yv are the values with which an error during the current adaptation, that is to say in the step i, would be completely compensated.

The adaptation of the straight line 26 or of the offset a and gradient b parameters which describe the straight line 26 is carried out by adapting the straight line 26 to the newly adapted operating point, characterized by the coordinates x2(i) and y2(i), and the remaining operating points, in the present exemplary embodiment of the first operating point 24 with the coordinates x1(i) and y1(i). In this context, the offset a and gradient b parameters of the profile of the straight line 26 from the adaptation step (i−1) are also taken into account. The adaptation can be carried out, for example, by minimizing the mean square error.

For the present case with two operating points 24, 28 and correspondingly two operating ranges, the determination of the new parameters of a straight line y=(a+x)*b is carried out as follows:

$$a'=a+\text{alpha}*(1/((x1+x2-2*(y1*x1+y2*x2/(y1+y2))*(y1+y2))*((y1*x2-x1*y2)+(y2*x1-x2*y1)*x2)-a)$$

$$b'=b+\text{alpha}*((y1+y2)/(x1+x2+2*ya)-b)$$

where the following applies:

$$ya=1/((x1+x2-2*(y1*x1+y2*x2)/(y1+y2))*(y1+y2))*((y1*x2-x1*y2)*x1+(y2*x1-x2*y1)*x2)$$

Here, the coordinates x1, y1 and x2, y2 respectively correspond to the coordinates of the operating point which is adapted in the current adaptation and of the remaining operating point.

For three operating points, the determination of the new parameters occurs as follows:

$$a'=a+\text{alpha}*(1/((x1+x2+x3-3*(y1*x1+y2*x2+y3*x3)/(y1+y2+y3))*(y1+y2+y3))*((y1*x2+x3)-x1*(y2+y3)+x1+(y2*(x1+x3)-x2*(y1+y3)*x2+(x1+x2)-x3*(y1+y2))*x3)-a)$$

$$b'=b+\text{alpha}*((y1+y2+y3)/(x1+x2+x3+3*ya)-b)$$

where the following applies:

$$ya=1/((x1+x2+x3)*(y1+y2+y3)-3*(y1*x1+y2*x2+y3*x3))*((y1*(x2+x3)-x1*(y2+y3))*x1+(y2*(x1+x3)-x2*(y1+y3))*x2+(y3*(x1+x2)-x3*(y1+y2))*3)$$

In an analogous fashion, the determination for the relationship y=a+x*b can be carried out by minimizing the square error.

The method is not restricted to the mathematical calculation explained above for the parameters for the underlying linear relationship $y_i=(a+x_i)*b$ or $y_i=a+b*x_i$, but instead the result can also be acquired according to another mathematical calculation of the parameters in a way analogous to that explained above. For example, a nonlinear relationship between the deviation (error) of the corrected fuel quantity $y_k$ from the fuel quantity $y_v$, determined from the pilot control process, can be modeled by $y_k-y_v=a+b*z$, where z is the nonlinear function $z=f(y_v)$, for example the Sigmoid $z=1/(1+\exp(-(y_v-u)/v))$ with the exponential function exp and permanently selected scaling parameters u and v. By minimizing the mean square error with respect to, for example, three determined operating points, the corrected parameters are determined according to $$a'=a+\text{alpha}*([(z1+z2+z3)*(y1*z1+y2*z2+y3*z*)-(y1+y2+y3)*(z1*z1+z2*z2+z3*z3)]/[(z1+z2+z3)*(z1+z2+z3)-3*(z1*z1+z2*z2+z3*z3)]-a)$$

$$b'=b+\text{alpha}*[(y1+y2+y3)*(z1+z2+z3)-3*(y1*z*+y2*z2+y3*z3)]/[(z1+z2+z3)*(z1+z2+z3)-3*(z1*z1+z2*z2+z3*z3)]-b)$$

In one expansion of the method according to the invention, a different adaptation rate for the offset and for the factor can be defined by a differentiated definition of the adaptation parameter alpha for the adaptation of the offset (alpha_a) and for the adaptation of the factor (alpha_b). Furthermore, different weighting of the contributions of the square errors is to the target function can be performed according to operating ranges with factors c1, c2 and c3. By minimizing the target function, the following is obtained in the case of three ranges given an assumed linear relationship: Y=(a+x)*b $$a' = a+\text{alpha_a}*((c1*(y1*(c2*x2+c3*x3)-x1*(c2*y2+c3*y3))*x1+c2*(y2*(c1*x1+c3*x3)-x2*(c1*y1+c3*y3))*x2+c3*(y3*(c1*x1+c2*x2)-x3*(c1*y1+c2*y2))*x3/((c1*x1+c2*x2+c3*x3)*(c1*y1+c2*y2+c3*y3)-(c1*y1*x1+c2*y2*x2+c3*y3*x3)*(c1+c2+c3))-a)$$

$$b' = b+\text{alpha_b}*((c1*y1+c2*y2+c3*y3)/(c1*x1+c2*x2+c3*x3+(c1+c2+c3)*(c1*(y1*(c2*x2+c3*x3)-x1*(c2*y2+c3*y$$

-continued $$3))*x1+c2*(y2*(c1*x1+c3*x3)-x2*(c1*y1+c3*y3))*x2+c3*(y3*(c1*x1+c2*x2)-x3*(c1*y1+c2*y2))*x3)/((c1*x1+c2*x2+c3*x3)*(c1*y1+c2*y2+c3*y3)-(c1*y1*x1+c2*y2*x2+c3*y3*x3)*(c1+c2+c3)))-b)$$

In order to calculate at operating points which have already been adapted once, the values x and y of the operating points 24, 28 are adjusted as described above cyclically or when adaptation is necessary (suspicion of an error) and the new parameters a and b are calculated therefrom. Alternatively, the adaptation values can also be continuously adjusted. The adaptation is considered to be concluded if the parameters a and b which are calculated in this way change between adaptation steps by less than a defined threshold value.

A suspicion of an error and a renewed need for adaptation can be determined as a function of the observed mixture error or the rate of change of the adaptation variables. In this context, specific requirements can be made of the operating range. In order to improve the adaptation accuracy it is possible to request a specific load point here.

The method permits the pilot control process to be adapted in adjoining operating ranges. It permits idling phases to be dispensed with more frequently for start/stop and hybrid systems, thereby reducing the fuel consumption.

For the initial calculation of the correction factors it is appropriate to require that the initial adaptation of operating points 24, 28 occur in two different operating ranges. If just one operating point 24, 28 is adapted, at least the parameter b can be determined from the adapted values x2, y2 using the initial values x1=0, y1=0, a=0. Given an assumed linear relationship it is possible, alternatively, to determine the gradient b as y/x for the first operating point 24, 28 which was reached during operation of the internal combustion engine, in the initial state without adaptation values for x1, y1, x2, y2. For this purpose, if necessary it is also possible to use an averaged operating point. Alternatively, the parameter b can be set to be equal to 1 and the parameter a can be determined from the deviation until the required operating points are available.

The adaptation can occur as follows given originally non-adapted characteristic operating points and adaptation values, for example in the case of an assumed linear relationship: the internal combustion engine is operated in a number of iteration steps in the operating range n, and the values xn and yn reach the mean value of the value distribution asymptotically. The gradient b is determined in this first phase from yn/xn. If the internal combustion engine is then operated in another operating range m, the values xm and ym are also used for the calculation of the adaptation values as soon as the values have reached a steady state. This can occur after a minimum number of values or alternatively when changes between xm(i−1) and ym(i−1) and xm(i) and ym(i) undershoot a threshold. The adaptation of the parameters a and b is concluded when the values are stable, i.e. changes of a and b each undershoot a predefined threshold value.

Figure 3:
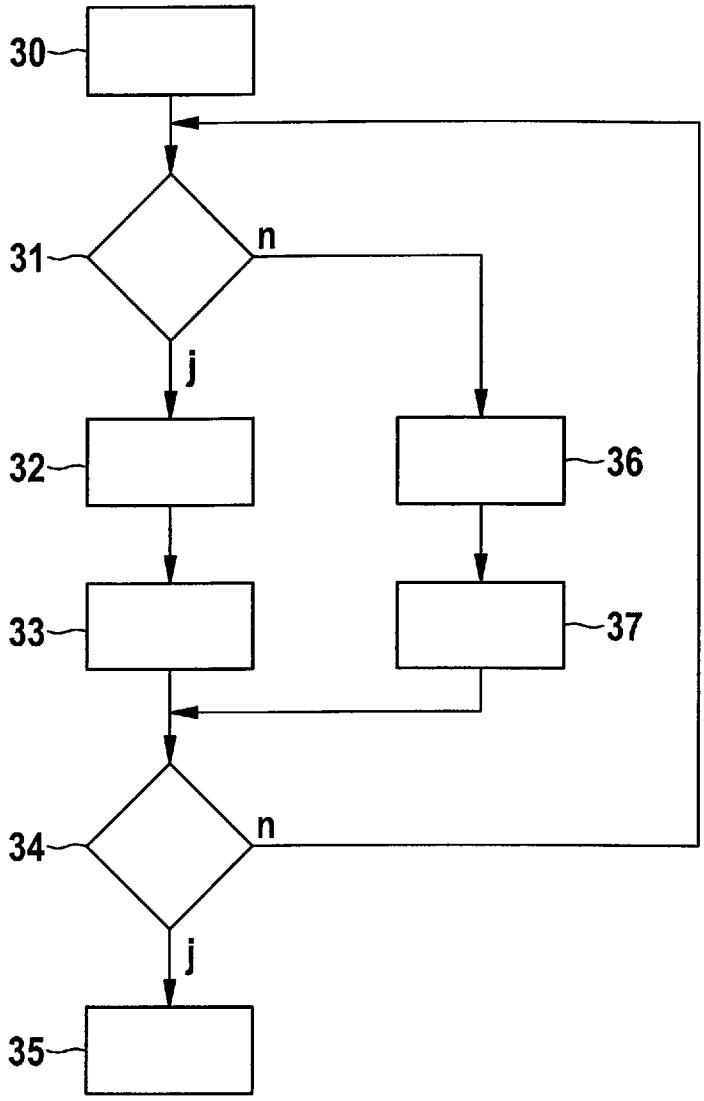
FIG. 3 shows a flowchart for the execution of an adaptation of a fuel/air mixture.

FIG. 3 shows, for example for an assumed linear relationship, a flowchart for carrying out an adaptation of a fuel/air mixture of a pilot control process on the basis of two operating points 24, 28. The sequence starts in a first function block 30. In a subsequent first interrogation 31 it is checked whether the internal combustion engine is operated in a first operating range to which the first operating point 24 is assigned. If this is the case, the sequence follows in a second function block 32. Here, the updating of the first operating point 24 takes place on the basis of the deviation of the current measuring point 22, as illustrated in FIG. 2. Using the updated first operating point, the offset a and gradient b parameters which describe the straight line 26 are updated in a third function block 33 in such a way that the error in the course of the straight line 26 relating to the updated first operating point and the unchanged second operating point 28 is minimized. In a second interrogation 34 it is subsequently checked whether the adaptation is stable, that is to say whether the necessary changes of the offset a and gradient b have not exceeded respectively predefined thresholds. If this is the case, the adaptation process is ended in a fourth function block 35. If the adaptation is not sufficiently stable, the sequence jumps back to before the first interrogation 31.

If the internal combustion engine is operated during the adaptation in a second operating range to which the second operating point 28 is assigned, the sequence branches off, after the first interrogation 31, to a fifth function block 36 and on to a sixth function block 37. Here, the straight line 26 is adapted in a way analogous to the described adaptation in the second and third function blocks 32, 33, but starting from the second operating point 28. If the offset a and gradient b parameters are determined in the sixth function block 37, the interrogation regarding the stability of the adaptation follows the second interrogation 34.

The invention claimed is:

1. A method for adapting a mixture for a pilot control process for setting a fuel/air mixture for operating an internal combustion engine, wherein the pilot control process sets a fuel quantity as a function of an air quantity by means of an adaptable parameterized relationship, characterized in that during an adaptation process a current measuring point is determined from an air quantity and a fuel quantity in which a predefined lambda is achieved, in that a current operating range in which the measuring point lies is determined, in that a deviation of the measuring point from an operating point lying in a current operating range is determined, in that a corrected operating point between the operating point and the measuring point is determined, and in that corrected parameters of a parameterized relationship are determined from the corrected operating point and the operating points and parameter values of a preceding adaptation step not lying in the current operating range.

2. The method according to claim 1, characterized in that the adaptable parameterized relationship is formed as a linear relationship which is determined by an offset and a gradient and runs through at least two operating points which are respectively determined by an air quantity and a fuel quantity and which lie in operating ranges of the internal combustion engine which are assigned to the respective operating points, wherein a corrected offset and a corrected gradient of a corrected linear relationship are determined as corrected parameters from the corrected operating point and the operating points not lying in the current operating range as well as the offset and the gradient of a linear relationship which is determined in a preceding adaptation step.

3. The method according claim 2, characterized in that the corrected, preferably linear, relationship is determined by the operating points in such a way that a mean square error of the deviation of the linear relationship, corrected in the current adaptation step, from the observed measured operating points is minimized.

4. The method according to claim 3, characterized in that a function for minimizing the mean square error of the operating points provides different weighting factors in different operating ranges.

5. The method according to claim 4, characterized in that the square minimization is carried out by means of a continuous calculation method based on current measured values over the entire operating range of the internal combustion engine.

6. The method according to claim 2, characterized in that the corrected relationship is determined from three operating points, one of which is an operating point which is corrected in the current adaptation step.

7. The method according to claim 2, characterized in that the offset is set to zero for an initial determination of a corrected relationship, and the gradient of the linear relationship is determined at an operating point of the internal combustion engine.

8. The method according to claim 2, characterized in that a second weighting factor is determined as a function of the distance of the current operating point from a limit, in that the second weighting factor is small when the distance is small and large when the distance is large, and in that during the determination of the corrected relationship, the contribution of the correction to the linear relationship is weighted with the second weighting factor.

9. The method according to claim 2, characterized in that the determination of the corrected relationship is carried out in each case with a weighting factor for the offset and one for the factor.

10. The method according to claim 2, characterized in that the offset is determined from the deviation and the factor is set to be equal to 1.

11. The method according to claim 1, characterized in that a parameterized nonlinear relationship is determined by determining the parameters during an adaptation process from the current measured values and the parameter values of the preceding adaptation step.

12. The method according to claim 1, characterized in that the corrected operating point is positioned on a line between the operating point in the current operating range and the measuring point at a distance from the operating point which is determined by a first weighting factor.

13. The method according to claim 1, characterized in that a new value pair $x_i$, $y_i$ is determined from a preceding value pair $x_{i-1}$, $y_{i-1}$ and a correction, provided with a weighting factor, formed from the difference of a currently observed value pair x, y and the preceding value pair $x_{i-1}$, $y_{i-1}$.

* * * * *